US006473058B1

(12) United States Patent
Hotomi et al.

(10) Patent No.: US 6,473,058 B1
(45) **Date of Patent: *Oct. 29, 2002**

(54) INFORMATION DISPLAY DEVICE AND DISPLAY CONTROL METHOD

(75) Inventors: Hideo Hotomi, Nishinomiya; Takashi Kondo, Sakai; Isao Hayami, Ashiya; Katsuyuki Nanba, Sakai; Sadafusa Tsuji, Tondabayashi, all of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/538,061

(22) Filed: Mar. 29, 2000

(30) Foreign Application Priority Data

Mar. 31, 1999 (JP) ..... 11-093009

(51) Int. Cl.[7] ..... G09G 5/00

(52) U.S. Cl. ..... 345/1.1; 345/345; 345/1.2; 345/211; 345/212; 345/87; 345/173; 345/901; 345/905; 345/618; 702/63; 340/7.1; 340/7.32; 340/7.37; 340/7.52; 455/572; 455/574; 455/556; 455/566; 455/558; 455/186.1

(58) Field of Search ..... 345/1.1, 1.2, 87, 345/173, 901, 905, 211, 212, 618; 702/63; 340/7.1, 7.32, 7.37, 7.52; 455/572, 574, 566, 556, 558, 186.1

(56) References Cited

U.S. PATENT DOCUMENTS 5,710,931 A * 1/1998 Nakamura et al. ..... 395/750
5,809,449 A * 9/1998 Harper ..... 702/63
5,842,123 A * 11/1998 Hamamoto et al. ..... 455/412
5,868,794 A * 2/1999 Barkley et al. ..... 607/5

* cited by examiner

*Primary Examiner*—Richard Hjerpe
*Assistant Examiner*—Jean Lesperance
(74) *Attorney, Agent, or Firm*—Sidley Austin Brown & Wood LLP

(57) ABSTRACT

An information display device can be structured as an electronic book which has a first screen and a second screen made of liquid crystal with a memory effect. A dry battery can be used as its power source section. The remaining electric power of the battery is detected by measuring the voltage, and immediately before the remaining electric power becomes a minimum voltage necessary for erasure of the screens, the first and second screens are reset so that the images displayed thereon can be erased.

12 Claims, 19 Drawing Sheets

INFORMATION DISPLAY DEVICE AND DISPLAY CONTROL METHOD

This application is based on application No. 11-93009 filed in Japan, the content of which is hereby incorporated by reference.

BACKGROUND OF THE INVENTION

1. Field of the Invention

The present invention relates to an information display device and a display control method, and more particularly to an information display device which has a display with a memory effect and a display control method adopted in the device.

2. Description of Related Art

At present, information is widely distributed by use of printed matter; it, however, increases the volume of garbage and promotes exhaustion of forest resource for paper pulp. These problems can be eased by developing a system of providing information being stored in digital information storage media so that users can get the information by use of display devices such as liquid crystal displays, electro luminescent displays, plasma display panels, etc. For example, various kinds of information which have been conventionally distributed by printed matter, such as books (paperbacks, weekly magazines, monthly magazines, technical papers, etc.), newspapers and advertisements can be distributed in the above-described way by an electronic book system.

Publishers (makers) distribute digital information of books as storage media to users which have (own or rent) a display device of an electronic book system, and each user puts the storage media in the display device to get the information.

In order to attain such a system, the display device must be as small and thin as a book so that the user can use it anywhere. It is, therefore, necessary to use a display with a memory effect which consumes little electric power, which requires a power source section of only a small size such as a dry battery, a small battery, a small capacitor or the like.

When such a power source section is used up, for example, when the battery comes to the end of its life, the image displayed on the display will stay thereon, which may cause trouble. For example, if the power source is used up while secret information is displayed on the display, the information will not be able to be erased until a new battery is loaded or until the power source section is recharged.

SUMMARY OF THE INVENTION

An object of the present invention is to provide an information display device which is capable of erasing an image from a display even when its power source section is used up and a display control method adapted in the display device.

Another object of the present invention is to provide an information display device which displays an image on a display without being influenced by the previous state of the display immediately after its power source section is recharged.

In order to attain the objects above, an information display device according to the present invention comprises: a display section which has a screen made of a material with a memory effect; a power source section which supplies electric power; a detecting section which detects a voltage supplied from the power source section; an erasure mode selecting member with which a user selects an erasure mode to erase the screen; and a control section which executes the erasure mode on conditions that the erasure mode is selected and that the voltage detected by the detecting section is not more than a specified voltage.

According to the present invention, immediately before the electric power of the power source section is used up, the information displayed on the screen is erased. Accordingly, there is no fear that the display may keep displaying secret information on the screen. There are cases wherein this erasure mode is not necessary, and for this reason, the erasure mode selecting member with which a user can select and cancel the erasure mode is provided. It is preferred that the selection or cancellation of the erasure mode is maintained even after recharge of the power source section. This arrangement eliminates the user's trouble of setting the erasure mode again after recharge of the power source section.

In the information display device according to the present invention, skip erasure to erase the screen while skipping pixels at intervals may be performed. If the skip erasure is performed in such a way to make the displayed information unrecognizable by other people, although the information is not completely erased, the secrecy is kept while less electric power is necessary for the erasure. For the same purpose, only part of the screen may be erased.

If the remaining electric power of the power source section is displayed on the screen, the user can recognize the exhaustion of the power source section and can prepare for recharge.

If the display section has a plurality of screens and if all the screens are subjected to operation in the erasure mode, execution of the erasure mode requires a large amount of electric power, and electric power which can be used for ordinary use of the information display device is reduced. In order to avoid the trouble, selection of at least one screen as the object of the erasure mode shall be possible. The control section figures out the number of screens which are capable of being erased in the erasure mode based on the remaining electric power. If the control section judges that the erasure mode cannot be executed toward all the screens, the control section issues a warning, or automatically selects at least one from the screens and erases only the selected screen. The selection of one or more screens as the object of the erasure mode may be made by the user.

The information display device according to the present invention may erase the screen also when the power source section is recharged. Since the display section uses a material with a memory effect, the display performance is influenced by the previous display state. For example, if a new image is written on the screen over an image displayed thereon, the contrast of the newly written image becomes uneven. In order to avoid such trouble, the screen is reset immediately after recharge of the power source section, and thereafter, a new image is written thereon. Thereby, an image of a high quality can be displayed.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Embodiments of an information display device and a display control method according to the present invention will be described with reference to the accompanying drawings. In the following embodiments, the present invention is mainly applied to an electronic book.

Appearance of Electronic Book

Figure 1:
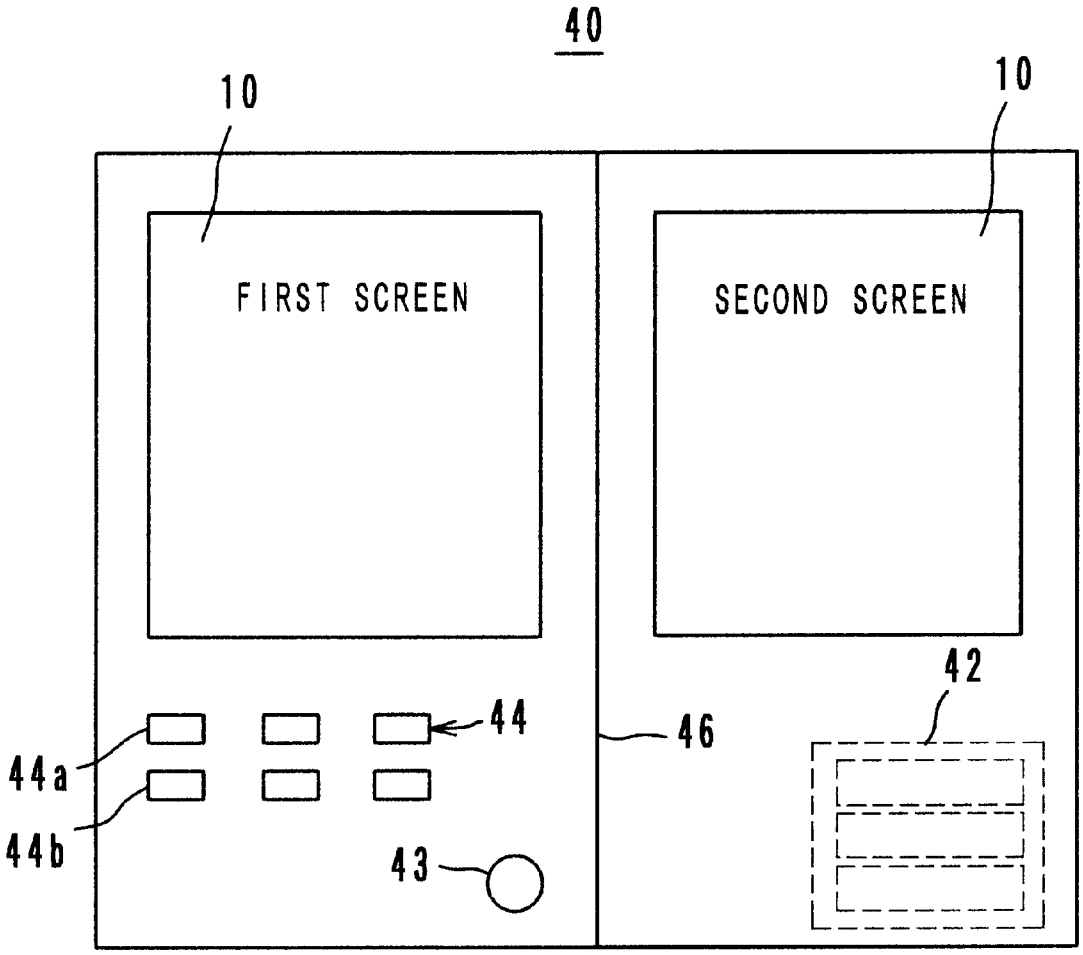
FIG. 1 is a front view of an electronic book which is an embodiment of the present invention.

FIG. 1 shows the appearance of an electronic book 40 which is a first embodiment of the present invention. The electronic book 40 is foldable in the center 46 and has a liquid crystal display 10. The liquid crystal display 10 has a first screen and a second screen on right and left, and on each of the screens, various kinds of literal and image information can be displayed as are written in books and magazines. The liquid crystal display 10 uses liquid crystal with a memory effect and is driven by a matrix method, and the structure and the driving method of the display 10 will be described in detail later.

A power source section 42 is provided in a lower part of the electronic book body under the second screen. The power source section 42 is, for example, composed of three AA dry cells of 1.5V. In a lower part of the electronic book body under the first screen, an operation section which comprises a power switch 43 and various operation switches 44 is provided.

Structure of Liquid Crystal Display

Figure 2:
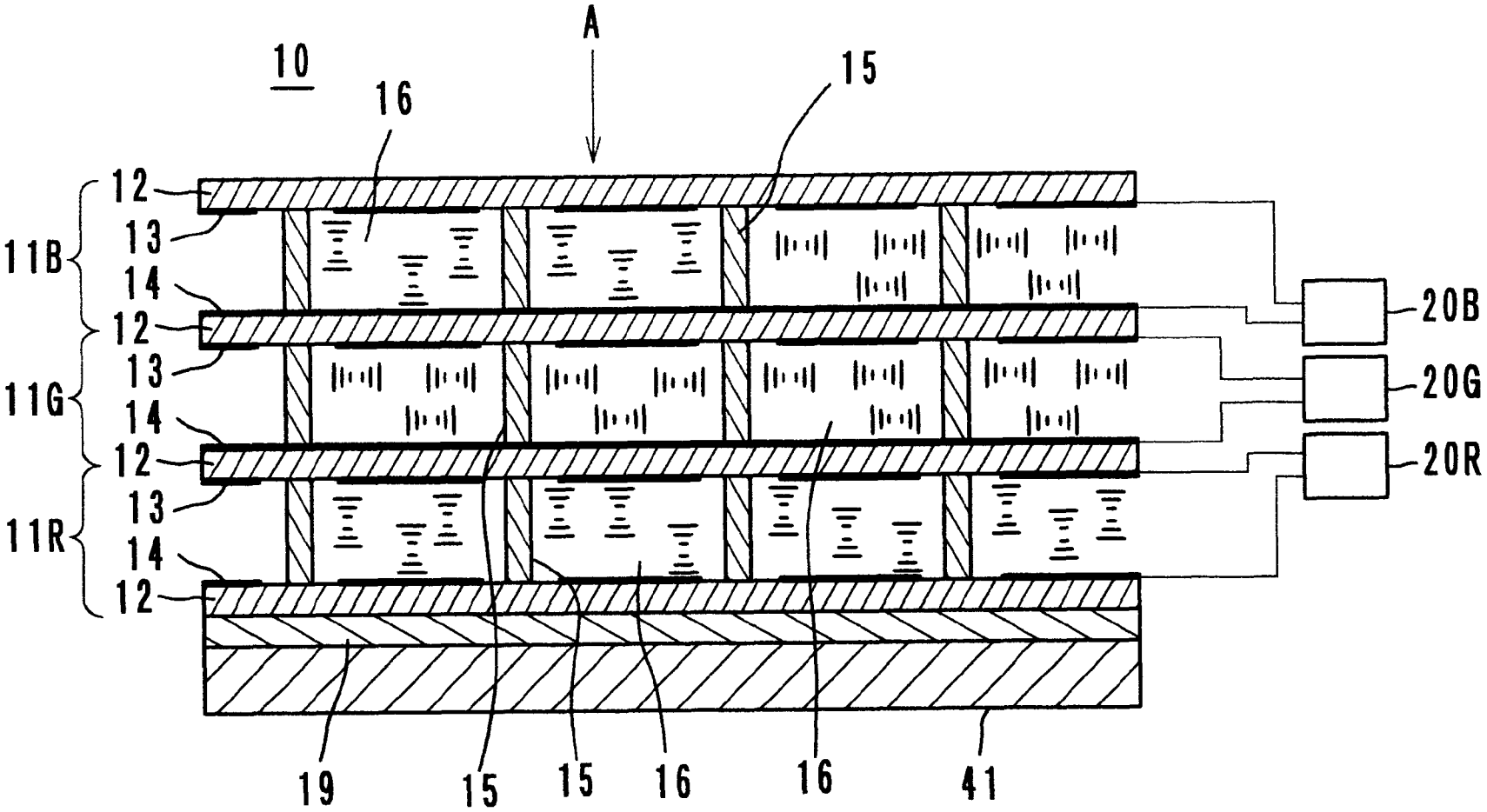
FIG. 2 is a sectional view of an exemplary liquid crystal display employed in the electronic book.

Next referring to FIG. 2, the liquid crystal display 10 is described. This liquid crystal display 10 has a light absorber 19 on a base film 41. On the light absorber 19, a red display layer 11R which makes a display by switching between a red selective reflection state and a transparent state is provided. On the red display layer 11R, a green display layer 11G which makes a display by switching between a green selective reflection state and a transparent state is provided, and on the layer 11G, a blue display layer 11B which makes a display by switching between a blue selective reflection state and a transparent state is provided.

Each of the display layers 11R, 11G and 11B has a resin columnar structure 15 and liquid crystal 16 between transparent substrates 12 which have transparent electrodes 13 and 14, respectively, thereon. On the transparent electrodes 13 and 14, an alignment controlling layer or an insulating layer may be provided.

The transparent electrodes 13 and 14 of the respective display layers 11B, 11G and 11R are connected to driving circuits 20B, 20G and 20R, and specified pulse voltages are applied between the electrodes 13 and 14. In each display layer, in response to the voltage applied, the liquid crystal 16 switches between a transparent state wherein the liquid crystal 16 transmits visible light and a selective reflection state wherein the liquid crystal 16 selectively reflects visible light of a specified wavelength, thereby switching a display.

The transparent electrodes 13 and 14 of each display layer are in the form of strips arranged in parallel at uniform intervals. The electrode strips 13 face the electrode strips 14, and the extending direction of the electrode strips 13 and the extending direction of the electrode strips 14 are perpendicular to each other. Electric power is applied between the upper electrode strips and the lower electrode strips. Thereby, a voltage is applied to the liquid crystal 16 in a matrix, so that the liquid crystal makes a display. This is referred to as a matrix drive. By performing this matrix drive toward the display layers sequentially or simultaneously, the liquid crystal display 10 displays a full-color image.

A liquid crystal display which has cholesteric liquid crystal or chiral nematic liquid crystal between two substrates makes a display by switching the liquid crystal between a planar state and a focal-conic state. In the planar state, the liquid crystal selectively reflects light of a wavelength $\lambda = P\ n$ (P: helical pitch of the cholesteric liquid crystal, n: average refractive index of the liquid crystal). In the focal-conic state, if the wavelength of light selectively reflected by the cholesteric liquid crystal is in the infrared spectrum, the liquid crystal scatters light, and if the wavelength of light selectively reflected is shorter than the infrared spectrum, the liquid crystal transmits visible light.

Therefore, by setting the wavelength of light selectively reflected by the liquid crystal within the visible spectrum and providing a light absorbing layer on the side of the display opposite the observing side indicated by arrow "A", the liquid crystal, in the planar state, makes a display of a color corresponding to the wavelength of light selectively reflected and in the focal-conic state, makes a black display. Also, by setting the wavelength of light selectively reflected by the liquid crystal within the infrared spectrum and providing a light absorbing layer on the side of the display opposite the observing side, the liquid crystal, in the planar state, reflects infrared light and transmits visible light, thereby making a black display, and in the focal-conic state, scatters light, thereby making a white display.

If the threshold voltage to untwist liquid crystal which exhibits a cholesteric phase (first threshold voltage) is Vth1, by applying the voltage Vth1 to the liquid crystal for a sufficient time and thereafter dropping the voltage to less than a second threshold voltage Vth2 which is lower than the first threshold voltage Vth1, the liquid crystal comes to the planar state. By applying a voltage which is higher than Vth2 and lower than Vth1 for a sufficient time, the liquid crystal comes to the focal-conic state. Each of the states is maintained even after stoppage of application of the voltage. It has been found that such liquid crystal also comes to a state where these two states are mixed. Accordingly, the liquid crystal can display intermediate tones, that is, can make a display with different tones.

Thus, liquid crystal which exhibits a cholesteric phase has a memory effect, which means that the liquid crystal can maintain its display after stoppage of application of a voltage. Therefore, by driving a plurality of pixels of the display by a simple matrix driving method, a display of a desired image or letters becomes possible. This kind of liquid crystal, however, has a hysteresis characteristic, and even when the same driving voltage is applied, the display changes depending upon the previous state of the liquid crystal.

In consideration for this characteristic, in an ordinary mode, first, all the pixels are reset to the focal-conic state, and thereafter, a selective signal is sent to the pixels to determine the state of each pixel. It takes a long time to change the liquid crystal into the focal-conic state; in this method, however, all the pixels are reset to the focal-conic state simultaneously, and reset of the liquid crystal to the focal-conic state must be carried out only once in making one display. As a result, the time for writing on the display by the simple matrix driving method is shortened.

Full-color Display

The liquid crystal display 10 which has color display layers 11R, 11G and 11B which are made of the above-described materials makes a red display by setting the liquid crystal 16 of the blue display layer 11B and the green display layer 11G to the focal-conic (transparent) state and setting the liquid crystal 16 of the red display layer to the planar (selective reflection) state. The liquid crystal display 10 makes a yellow display by setting the liquid crystal 16 of the blue display layer 11B to the focal-conic (transparent) state and setting the liquid crystal 16 of the green display layer 11G and the red display layer 11R to the planar (selective reflection) state. By setting the liquid crystal 16 of the respective color display layers to the transparent state or to the selective reflection state appropriately, displays of red, green, blue, white, cyan, magenta, yellow and black are possible. Also, by setting the liquid crystal 16 of the respective color display layers to the intermediate state, displays of intermediate colors are possible. Thus, the liquid crystal display 10 can be used as a full-color display.

Producing Method of Liquid Crystal Display

Figure 3:
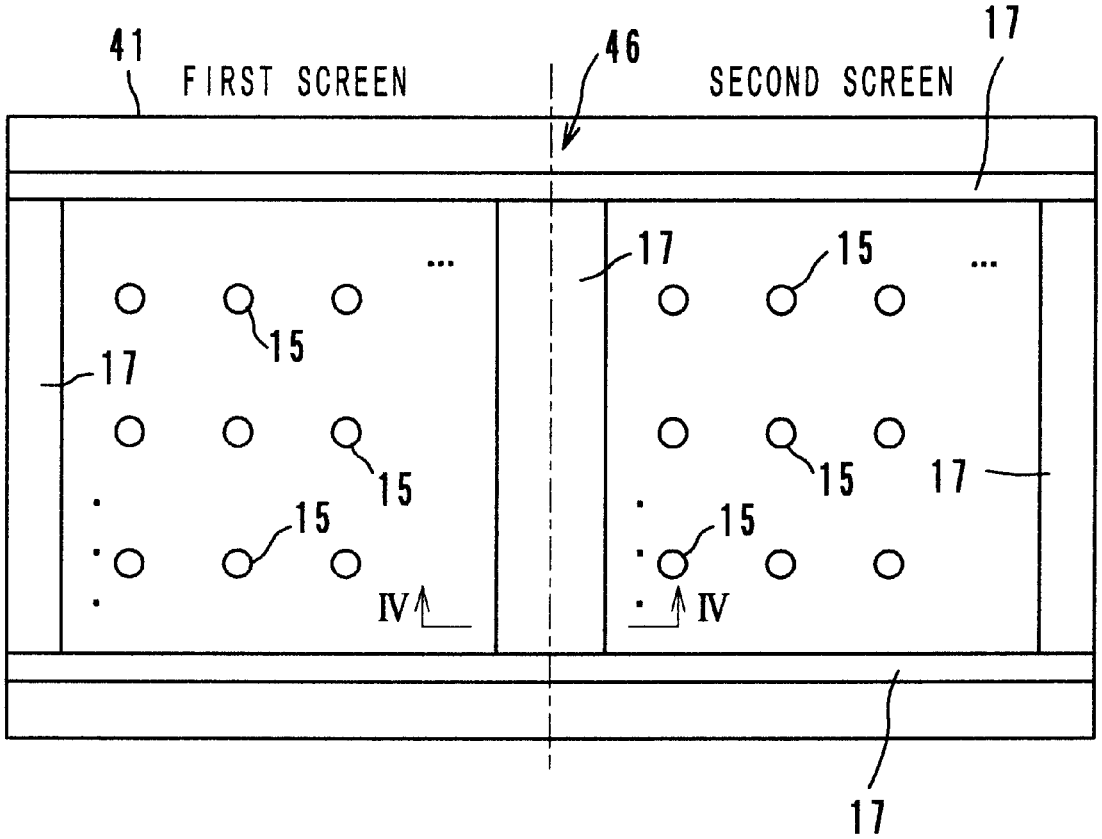
FIG. 3 is an illustration which shows a manufacturing process of the liquid crystal display.
Figure 4:
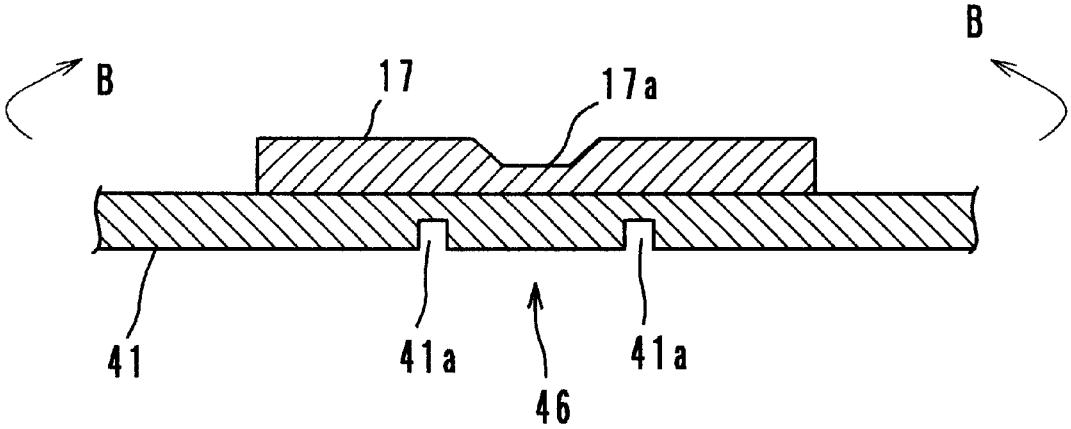
FIG. 4 is an enlarged sectional view of the illustration shown by FIG. 3, taken along a line IV—IV in FIG. 3.

The liquid crystal display 10 is produced by laminating the three display layers 11R, 11G and 11B on the base film 41 in this order. FIG. 3 shows a state where the display layer 11R is laid on the base film 41, and liquid crystal is enclosed by a sealant 17 and sealed therein. FIG. 4 is a sectional view of the center portion 46. Fold grooves 41*a* are formed in the base film 41, and a groove 17*a* is formed in the sealant 17. Thereby, the electronic book 40 is foldable in a direction indicated by arrow "B".

Driving Circuit and Driving Method of Liquid Crystal Display

Figure 5:
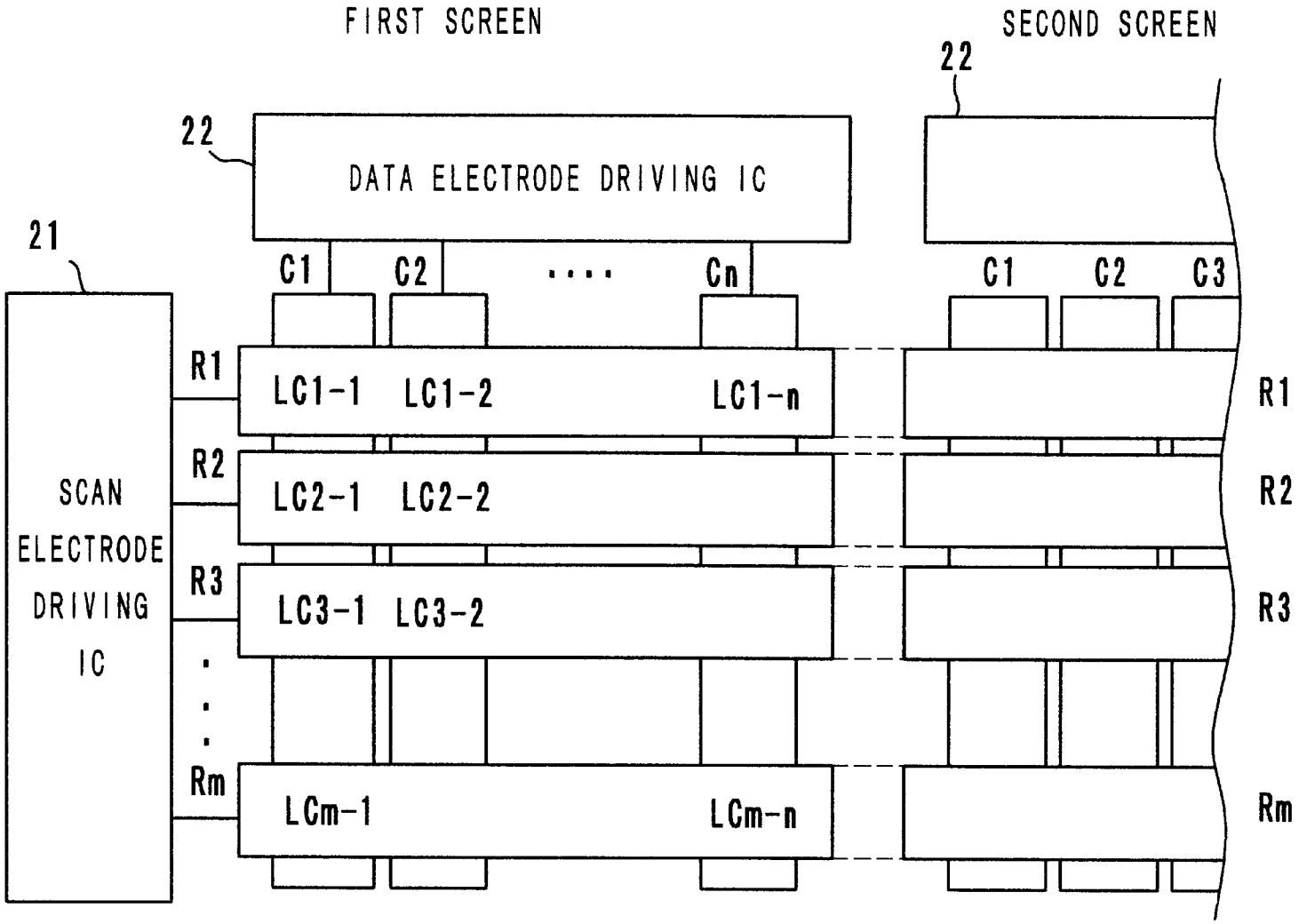
FIG. 5 is a block diagram which shows a matrix driving circuit of the liquid crystal display.

In each of the display layers of the liquid crystal display device 10, the pixels are structured in a simple matrix. Therefore, as FIG. 5 shows, the pixels can be expressed by a matrix of m×n, in which m is the number of scan electrodes (R1, R2 . . . Rm), and n is the number of data electrodes (C1, C2 . . . Cn). The pixel which is at the intersection of a scan electrode Ra and a data electrode Cb (a, b: natural numbers, $a \leqq m$, $b \leqq n$) is expressed by LCa−b. The scan electrodes and the data electrodes are connected to output terminals of a scan electrode driving IC 21 and to output terminals of a data electrode driving IC 22, respectively, and a scan voltage and data voltages are applied to the respective electrodes from the driving ICs 21 and 22.

In each of the display layers, the scan electrodes extend between the two screens of the liquid crystal display 10, and the scan electrodes are driven by one scan electrode driving IC 21. The scan electrodes extend between the two screens of the liquid crystal display 10 and extend over the sealant 17 shown in FIG. 4. The groove 17*a* of the sealant 17 has such a configuration not to cut the scan electrodes when the electronic book 40 is folded.

The driving circuit for the liquid crystal display 10 is not limited to such a matrix-structured driver. It is possible to carry out serial transmission of image data from the data electrode driving IC 22 via a line latch memory for each line of the scan electrode driving IC 21. In this case, the scan electrode driving IC 21 does not have to cope with lines, and an IC for serial usage is sufficient. Thus, the cost for the driver can be reduced.

Figure 6:
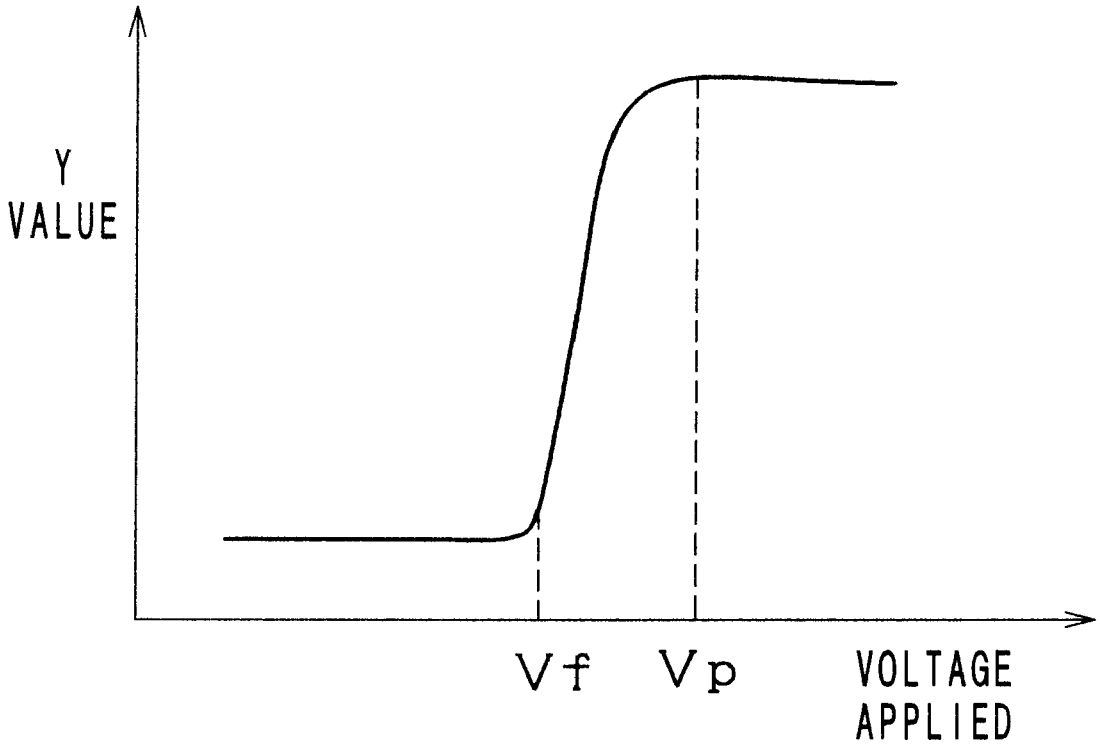
FIG. 6 is a graph which shows the relationship between the voltage of a selective signal and the Y value.

In the liquid crystal display 10, the display state of the liquid crystal is a function of the voltage applied and the pulse width. By resetting the whole liquid crystal to the focal-conic state wherein the liquid crystal shows the lowest Y value (luminous reflectance) and thereafter, applying a pulse voltage with a constant pulse width to the liquid crystal, the display state of the liquid crystal changes as FIG. 6 shows. In the graph of FIG. 6, the y-axis indicates the Y value, and the x-axis indicates the voltage applied. When a pulse voltage Vp is applied, the liquid crystal comes to the planar state wherein the liquid crystal shows the highest Y value, and when a pulse voltage Vf is applied, the liquid crystal comes to the focal-conic state wherein the liquid crystal shows the lowest Y value. Also, when an intermediate pulse voltage between Vp and Vf is applied, the liquid crystal comes to an intermediate state between the planar state and the focal-conic state wherein the liquid crystal shows an intermediate Y value, and thus, a display of an intermediate color is possible.

Rapid Display Mode by Phase Transition Drive

Figure 7:
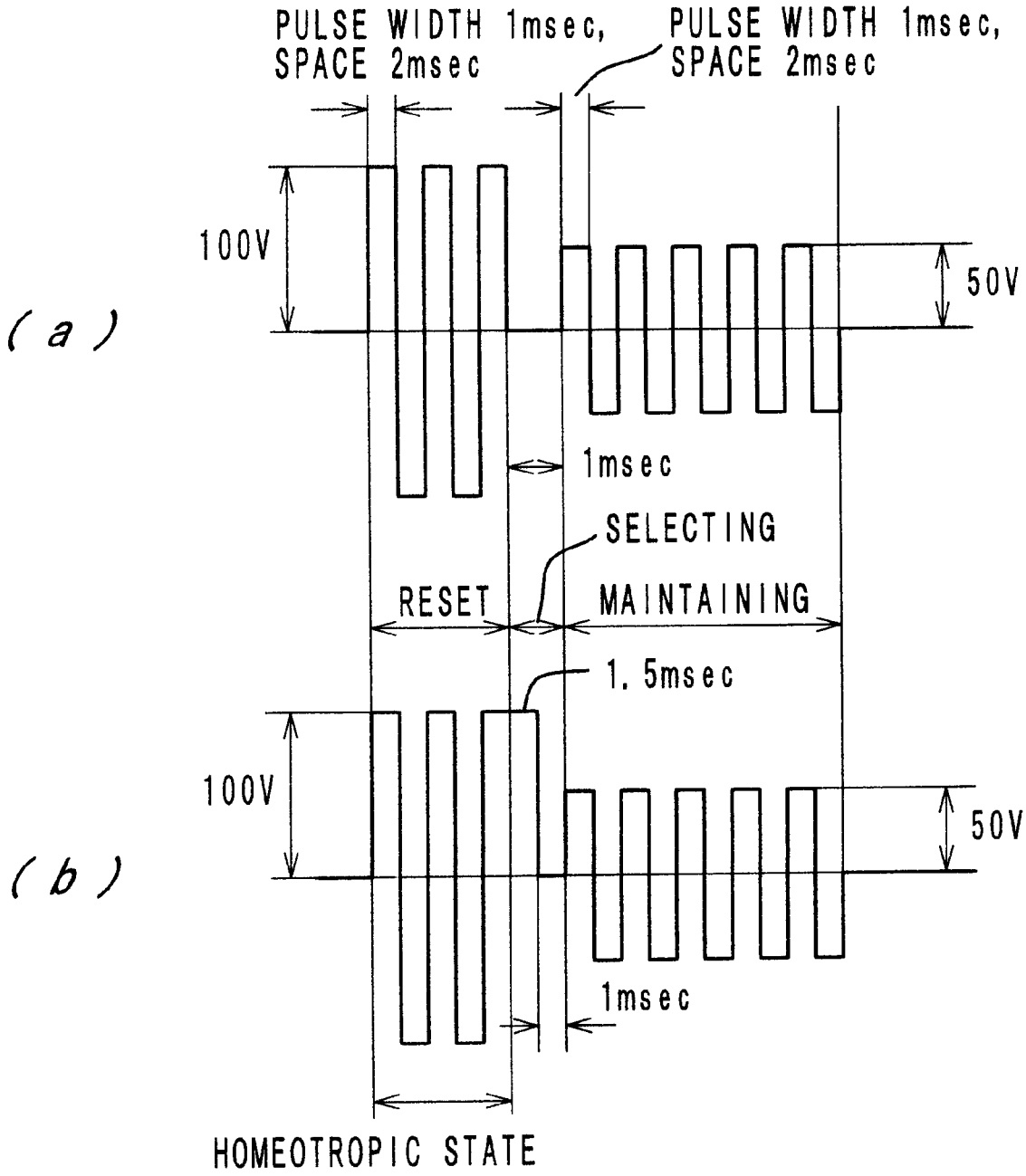
FIG. 7 is a chart which shows the waveforms of voltages applied for operation in a rapid display mode.

FIG. 7 shows waveforms (a) and (b) of pulse voltages to drive the liquid crystal display 10 in a rapid display mode.

In the case of waveform (a), first in a reset duration, a pulse voltage of 100V is applied to the liquid crystal to cause the liquid crystal to come to a homeotropic state, and in a selecting duration, no voltages are applied. Then, in a maintaining duration, a pulse voltage of 50V is applied. In this case, the liquid crystal comes to the focal-conic state and maintains the state, that is, scatters light incident thereto (off state). In the case of waveform (b), the liquid crystal is reset to the homeotropic state, and subsequently, a pulse voltage of 100V is applied for 1.5msec. Then, in the maintaining duration, a pulse voltage of 50V is applied. In this case, the liquid crystal changes to the planar state and maintains the state, that is, transmits light incident thereto (on state). By selecting the waveform (a) or (b) in accordance with image data, a two-value (on and off) image can be displayed.

Driving Method in Ordinary Display Mode

Figure 8:
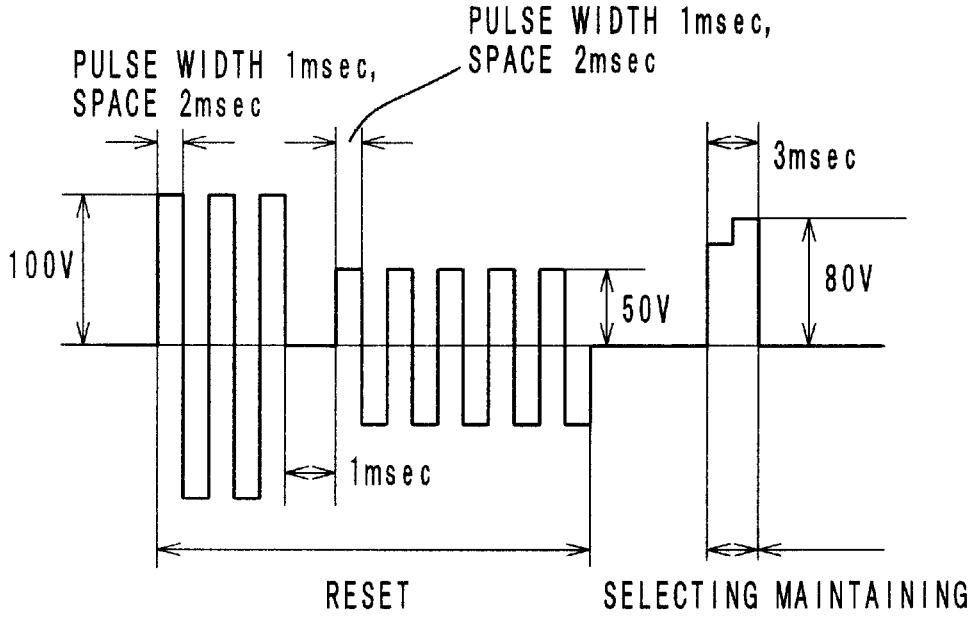
FIG. 8 is a chart which shows the waveform of a voltage applied for operation in an ordinary display mode.

FIG. 8 shows the waveform of a pulse voltage which drives the liquid crystal display 10 to make a multi-tone display in the ordinary display mode. In a reset duration, the liquid crystal is reset to the focal-conic state, and in a selecting duration, a pulse voltage which changes between two stages is applied for three milliseconds to reproduce a multi-tone image. In a maintaining duration, a voltage of 0V is applied. Not only the method in which the voltage of the waveform shown by FIG. 8 is applied but also any other driving method can be adopted for operation in the ordinary display mode.

Erasure Mode

The power source of this electronic book 40 is a dry battery, and the liquid crystal display 10 has a memory effect. Therefore, if the dry battery is used up while an image is displayed on the liquid crystal display 10, the image will stay thereon, that is, will not be able to be erased until a new dry battery is loaded. If the image is about secret matter, it is inconvenient.

Figure 9:
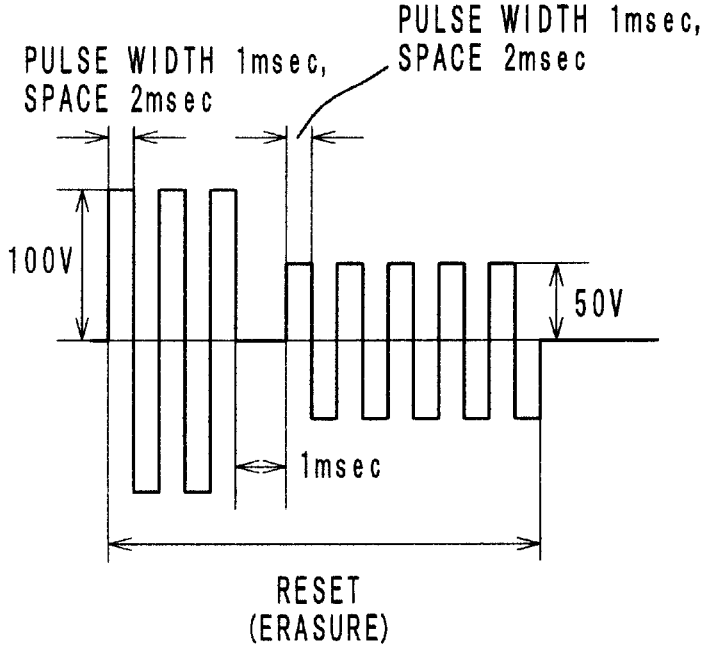
FIG. 9 is a chart which shows the waveform of a reset voltage applied for operation in an erasure mode
Figure 10:
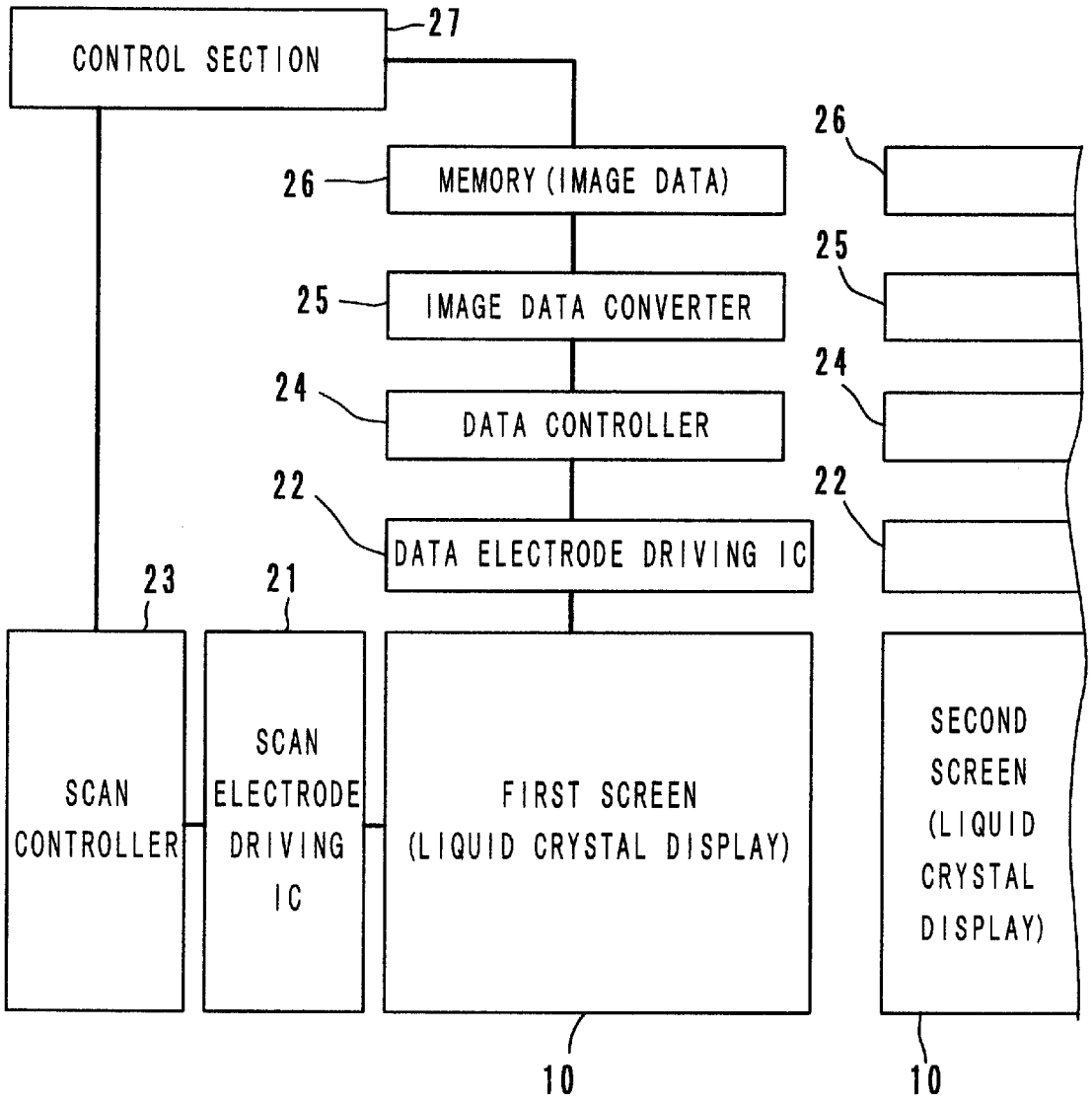
FIG. 10 is a block diagram of a driving/image signal processing circuit of the electronic book.

In this embodiment, the following measure is taken in order to prevent such inconvenience: the voltage of the battery is detected by a detecting circuit at all times; the remaining electric power is calculated by a control circuit 27 shown by FIG. 10; and the image is erased immediately before the electric power becomes a minimum voltage necessary for the erasure. FIG. 9 shows the waveform of a voltage to execute this erasure mode. This voltage is of the same waveform as the voltage which is applied during the reset duration in the ordinary display mode shown by FIG. 8, and the voltage is to reset the liquid crystal to the focal-conic state.

FIG. 10 is a driving/image signal processing circuit in which image data are rewritable. The main member of this circuit is a control section 27. Each display layer of the liquid crystal display 10 is connected to the scan electrode driving IC 21 and the data electrode driving IC 22. These driving ICs 21 and 22 are driven in accordance with signals sent from a scan controller 23 and a data controller 24. Image data to be written on the display layer are inputted from the memory 26 to the data controller 24; before that, however, the data are converted into a selection signal by an image data converter 25.

First Example of Erasure Mode

Figure 11:
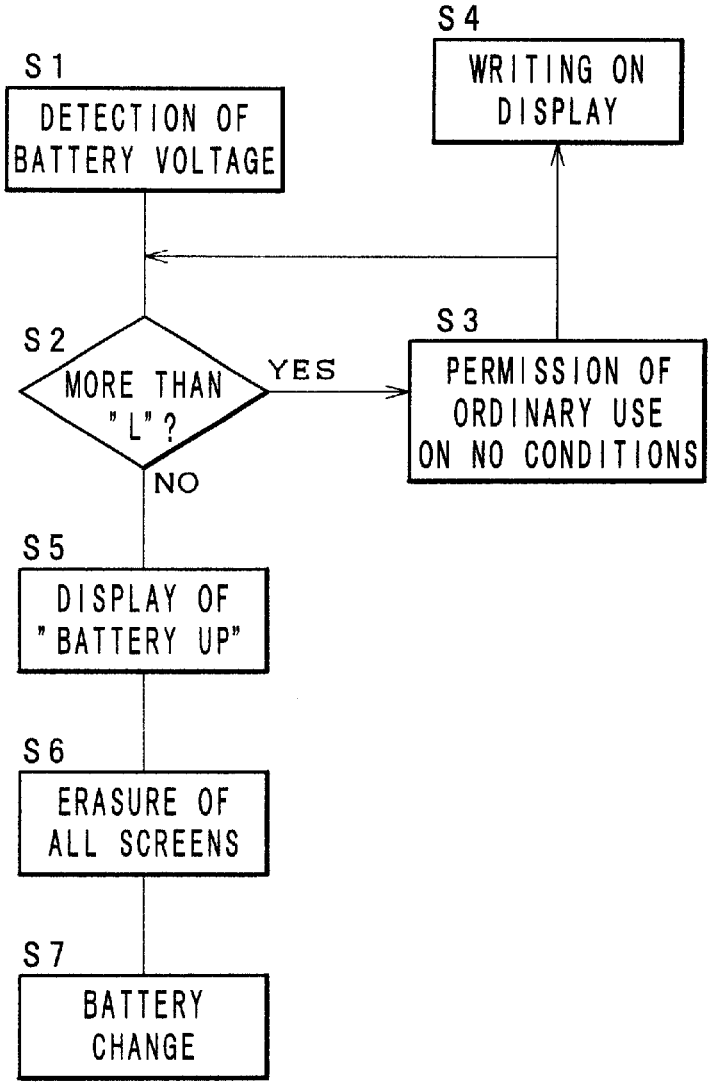
FIG. 11 is a flowchart which shows a control procedure to execute a first example of the erasure mode.
Figure 12:
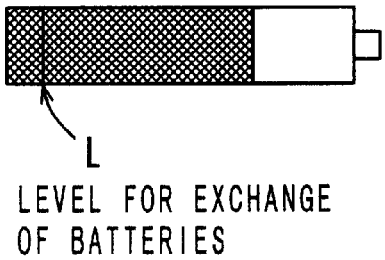
FIG. 12 is an illustration which shows a way of displaying the remaining electric power of a power source section.

FIG. 11 shows a first example of the erasure mode. First at step S1, the voltage of the battery is detected to figure out the remaining electric power. The remaining electric power is displayed as an illustration shown by FIG. 12 either on the first screen or on the second screen. In the illustration shown by FIG. 12, the dark part indicates the remaining electric power. In FIG. 12, the letter "L" indicates the level to require an exchange of batteries. The value "L" corresponds to electric power which is required for reset of the whole first and second screens.

Next at step S2, when it is judged that the remaining electric power is more than the value "L", continuation of the ordinary use is permitted on no conditions at step S3, and the control circuit complies with a request for writing on the liquid crystal display 10 at step S4. On the other hand, when it is judged at step S2 that the remaining electric power has come down almost to the value "L", a message which indicates that the battery has been used up is displayed on either the first screen or the second screen at step S5, and the erasure mode is executed at step S6. More specifically, the whole first and second screens are reset by use of the remaining electric power to erase the displayed images. Thereafter, the user exchanges batteries at step S7.

According to the first example, images are erased from the screens immediately before the battery is used up. Moreover, since the remaining power of the battery is displayed on one of the screens, the user can expect the use-up of the battery and can prepare a new battery.

Second Example of Erasure Mode

Figure 13:
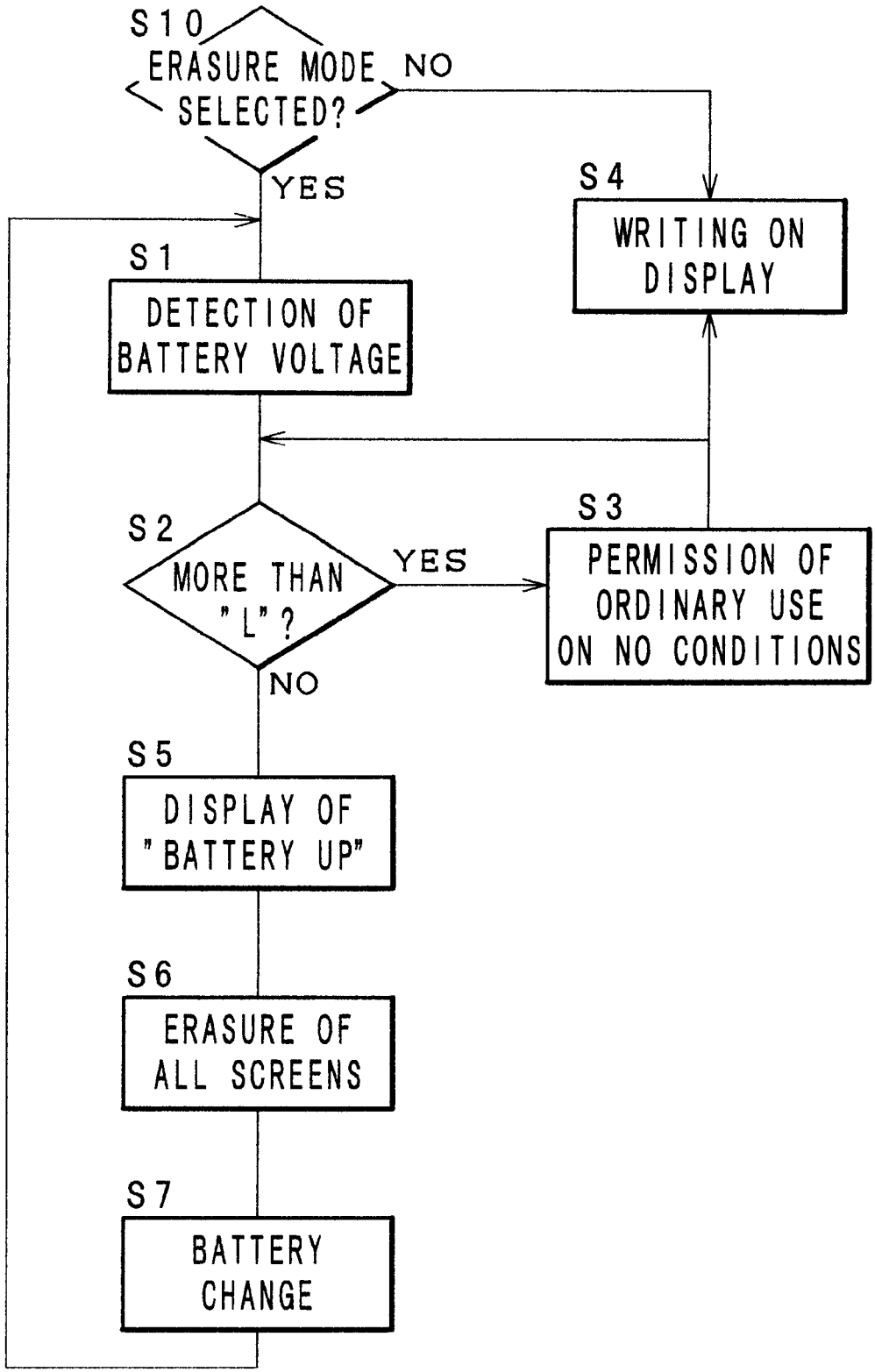
FIG. 13 is a flowchart which shows a control procedure to execute a second example of the erasure mode.

FIG. 13 shows a second example of the erasure mode. First at step S10, it is judged whether or not the user has selected the erasure mode. The user can select the erasure mode by pressing the mode selection switch 44*a* (see FIG. 1) once. The user can cancel the erasure mode by pressing the switch 44*a* twice. If the erasure mode is not selected, the program goes to step S4 to comply with a request for writing on the liquid crystal display 10. If the erasure mode is selected, the control circuit follows the procedure shown by FIG. 11 to reset the whole first and second screens immediately before the use-up of the battery.

Execution of the erasure mode is not always desired by the user. By enabling the user to select and cancel the erasure mode, the electronic book 40 can be more convenient to the user. In this second example, when the user has exchanged batteries at step S7, the program goes back to step S1, which means that the selection/cancellation of the erasure mode made by the user's operation of the switch 44*a* is maintained after the exchange of batteries. This eliminates the user's trouble of setting the mode again.

Third Example of the Erasure Mode

Figure 14A:
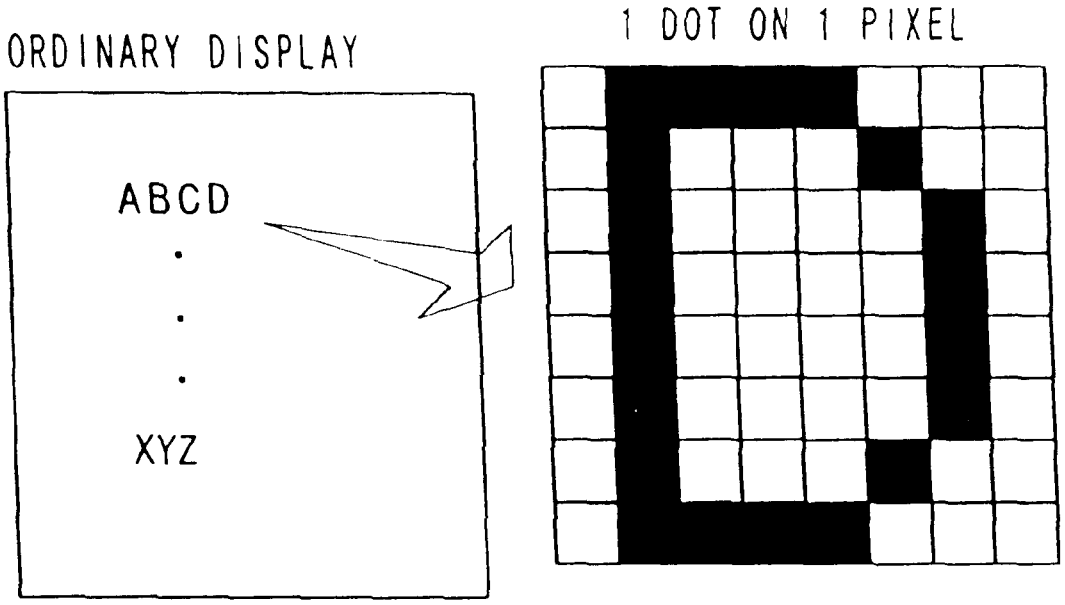
FIGS. 14*a* and 14*b* are illustrations which show a third example of the erasure mode, FIG. 14*a* showing a way of displaying information in the ordinary display mode and FIG. 14*b* showing skip erasure to reset pixels on every other scan electrodes.
Figure 14B:
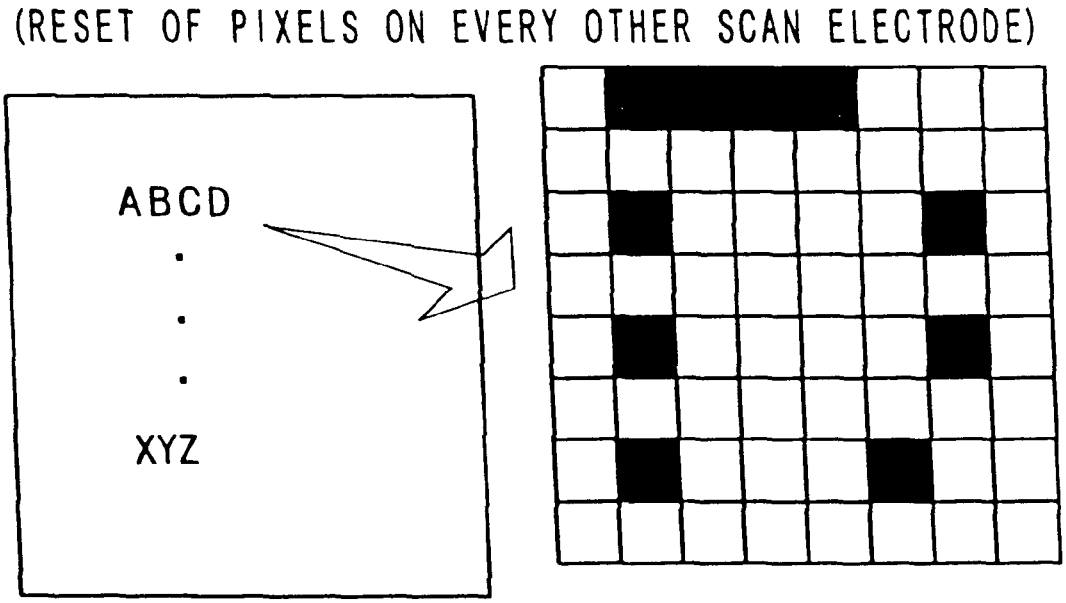

FIGS. 14*a* and 14*b* show a third example of the erasure mode. In the third example, erasure is performed while skipping pixels at intervals, and more specifically, the pixels on every other scan electrode are reset. For example, when a letter "D" which is displayed in the dot structure shown by FIG. 14*a* is subjected to skip erasure according to this third example, the letter "D" becomes unrecognizable as shown by FIG. 14*b*, which brings the same effect as obtained by completely erasing the letter "D". The electric power required for this skip erasure is only a half of that required for complete erasure of the whole screens. In other words, this skip erasure of the first and second screens can be carried out by consuming only electric power required for complete erasure of one screen. Therefore, the level "L" shown in FIG. 12 can be lowered, and accordingly, the duration for ordinary use (display of information) of the electronic book 40 can be prolonged.

Fourth Example of Erasure Mode

In the fourth example, the erasure mode can be executed in three ways. The first is to erase the image from only the first screen. The second is to erase the image from only the second screen, and the third is to erase the images from both the first screen and the second screen. The user can select one of the above erasure modes cyclicly by use of the operation switch 44*b* shown in FIG. 1. More specifically, the user can select the first screen erasure mode by pressing the switch 44*b* once, select the second screen erasure mode by pressing the switch 44*b* twice and select the first and second screen erasure mode by pressing the switch 44*b* three times.

According to this fourth example, when the user selects either the first screen erasure mode or the second screen erasure mode, the electric power required for the erasure is only a half of that required for erasure of both of the two screens, and the duration for ordinary use of the electronic book 40 can be prolonged. Further, if the third example is also adopted, the duration for ordinary use can be more prolonged.

Fifth Example of Erasure Mode

Figure 15:
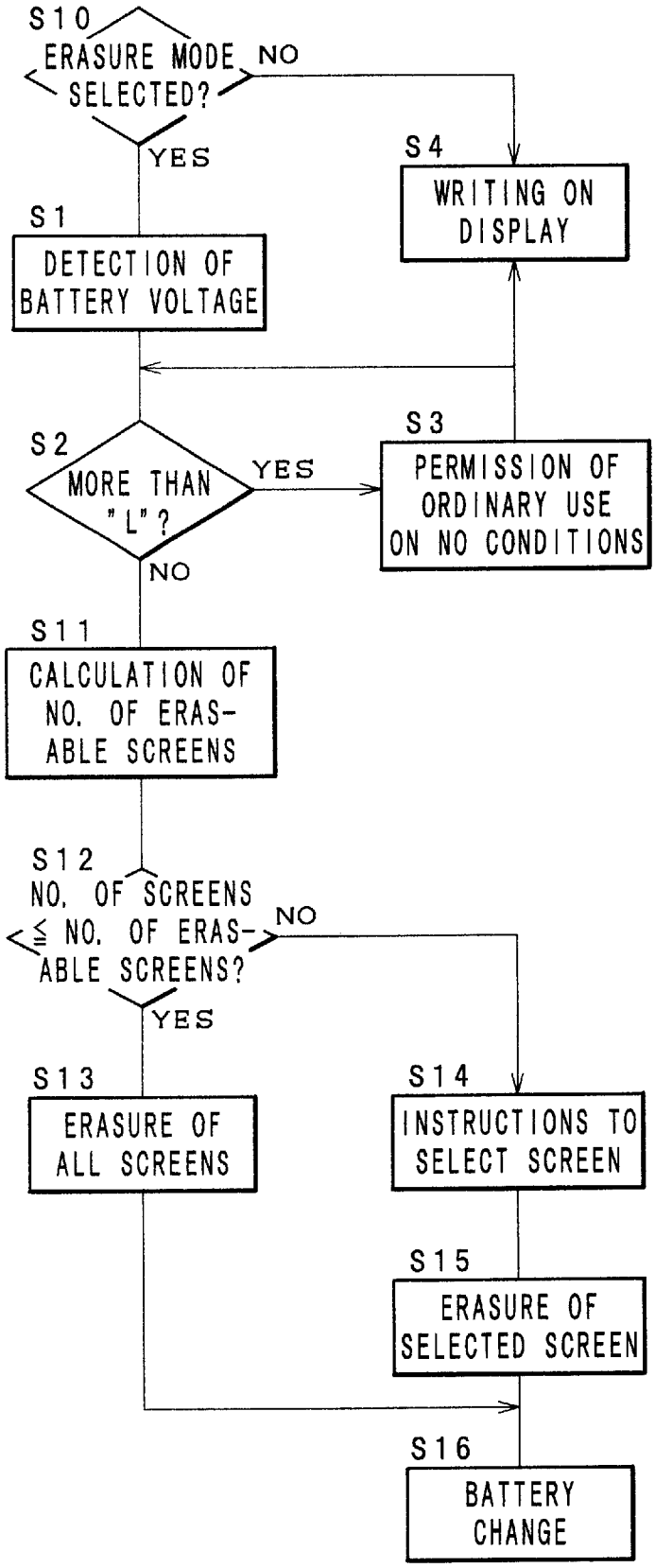
FIG. 15 is a flowchart which shows a control procedure of a fifth example of the erasure mode.

FIG. 15 shows a fifth example of the erasure mode. In the fifth example, when it is judged at step S2 that the remaining electric power becomes less than a specified value, the number of screens which can be erased by use of the remaining electric power is figured out at step S11, and the number of screens figured out at step S11 is compared with the number of screens to be erased at step S12. If it is judged that erasure of all the screens is possible, all the screens are erased at step S13, and the program goes to step S16.

If it is judged that erasure of all the screens is impossible, at step S14, the user is instructed to select a screen to be erased, and in accordance with the user's selection, only the selected screen is erased at step S15. Then, the user exchanges batteries at step S16.

In this fifth example, a warning display may be made when it is judged at step S12 that the number of screens figured out at step S11 is smaller than the number of screens to be erased. Otherwise, selection of a screen may be made automatically. The volume of information displayed on the first screen and that of information displayed on the second screen are compared with each other, and the screen with a smaller volume of information thereon is automatically selected to be erased.

Sixth Example of Erasure Mode

Figure 16:
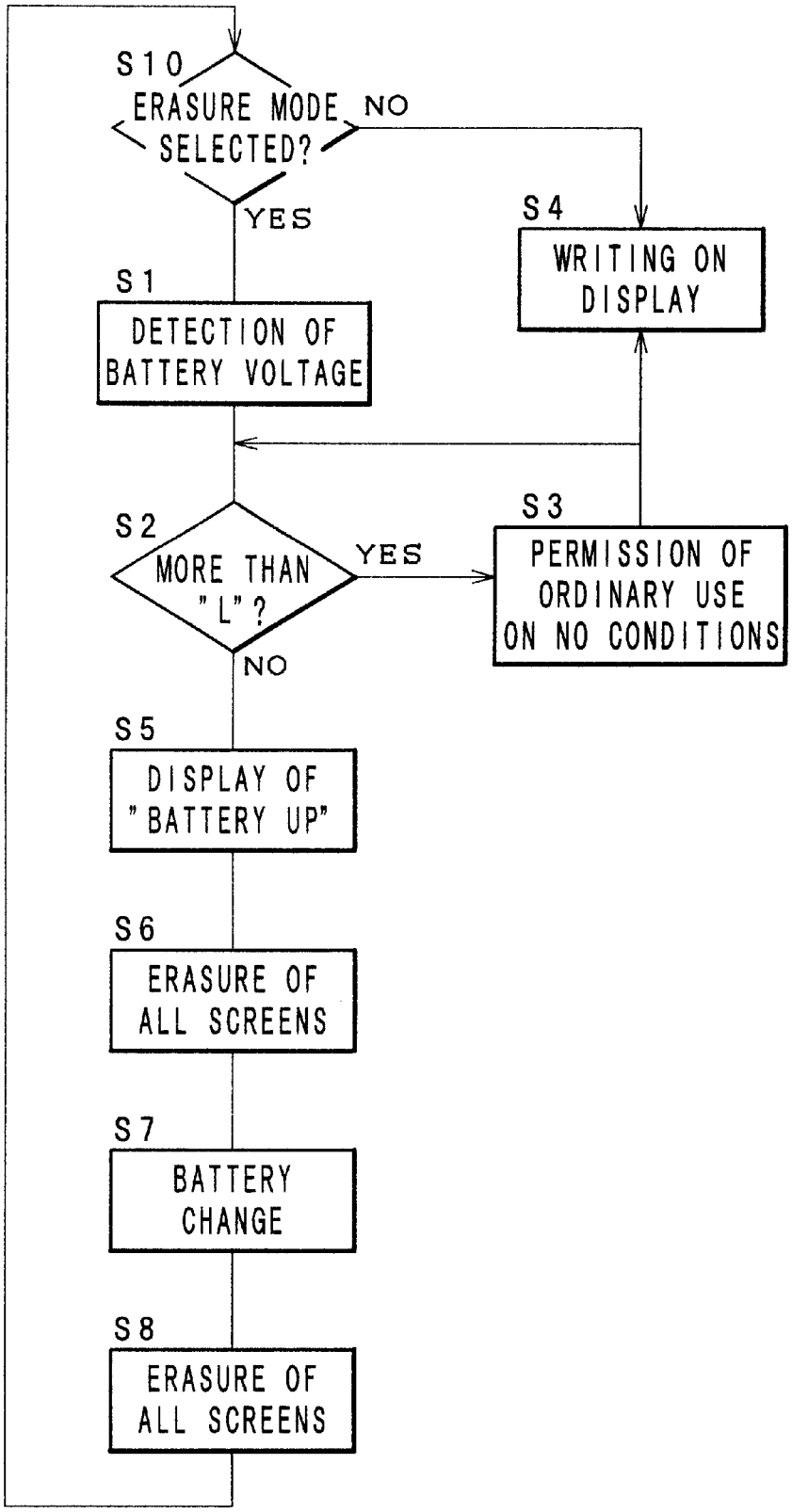
FIG. 16 is a flowchart which shows a control procedure of a sixth example of the erasure mode.

In the sixth example, as FIG. 16 shows, immediately after the user exchanges batteries, at step S8, the first screen and the second screen are reset. Since the liquid crystal used in this embodiment has a memory effect, contrast unevenness or any other trouble is likely to occur on a newly written image influenced by the image which was previously displayed thereon. In the sixth example, reset of the whole screens is performed immediately after an exchange of batteries so that new images can be written on the screens without being influenced by the images previously displayed thereon. The steps in FIG. 16 other than step S8 are the same as the steps shown in FIG. 13, and description of these steps is omitted.

Seventh Example of Erasure Mode

Figure 17:
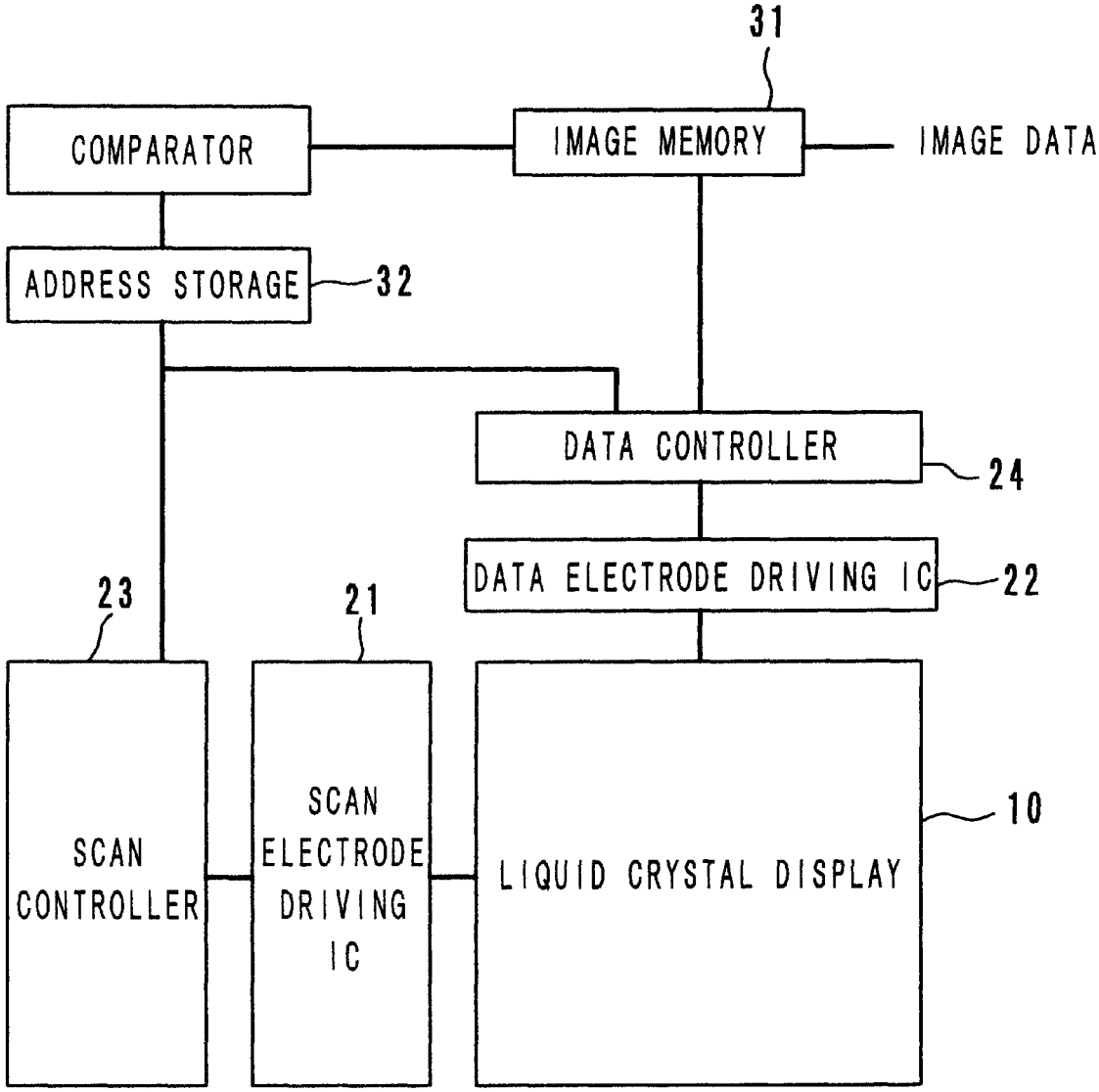
FIG. 17 is a block diagram which shows a control circuit used in a seventh embodiment of the erasure mode.

In the seventh example, in executing the erasure mode, a voltage lower than a reset effective voltage or a voltage of 0 is applied to pixels with no information displayed thereon. The distinguishing of the pixels with no information thereon from pixels with information thereon can be made in accordance with image data stored in the image memory 31 shown in FIG. 17. The pixels with no information thereon have been in a reset state, and it is not necessary to apply a reset voltage to these pixels for erasure. By applying the reset voltage only to the pixels with information thereon, the power consumption for execution of the erasure mode can be reduced. This selective voltage application can be made by storing the addresses of image data stored in the image memory 31 in an address storage 32 as FIG. 17 shows.

Eighth Example of Erasure Mode

Figure 18:
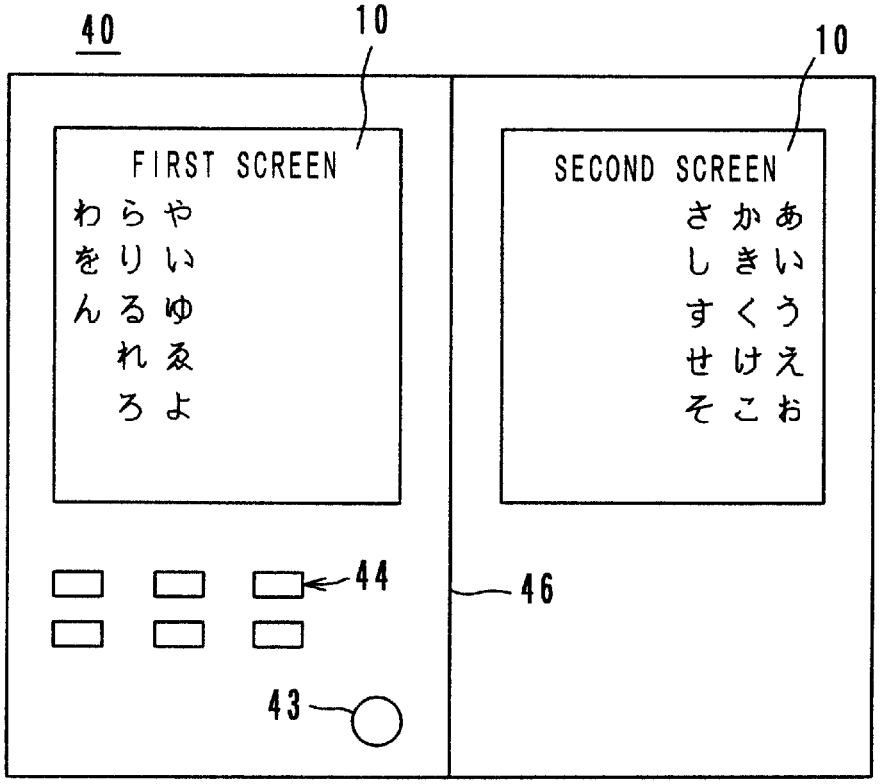
FIG. 18 is an illustration which shows an exemplary way of erasing information according to an eighth example of the erasure mode.

According to the eighth example, in the erasure mode, the first screen and the second screen are partly erased. FIG. 18 shows a state wherein the first screen and the second screen have been erased in the erasure mode according to the eighth example. In the case of FIG. 18, Japanese sentences were written vertically, and the right half of the first screen and the left half of the second screen are erased. According to the eighth example, the electric power required for execution of the erasure can be reduced.

Ninth Example of Erasure Mode

Figure 19:
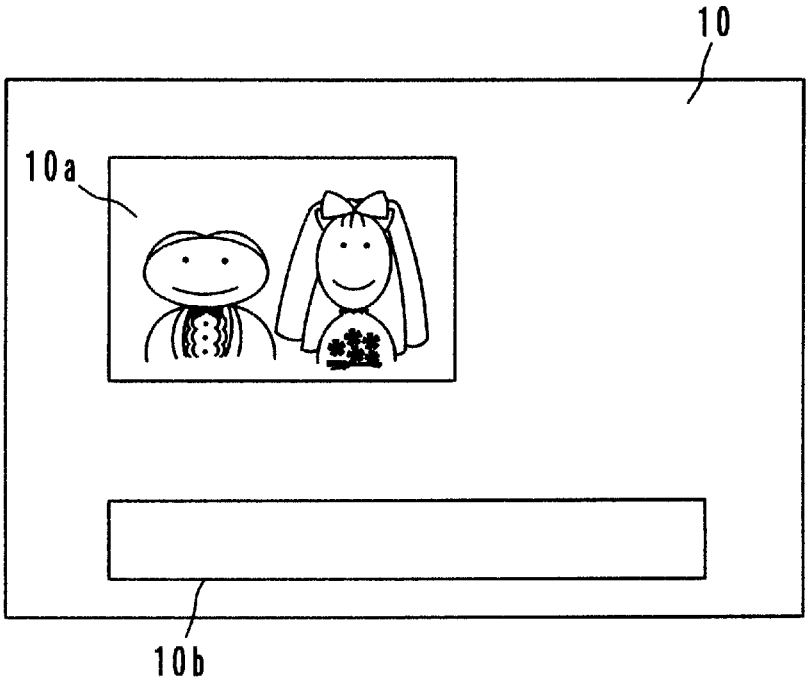
FIG. 19 is a front view of a bulletin board to which a ninth example of the erasure mode is applied.

FIG. 19 shows a bulletin board according to the present invention. The liquid crystal display 10 of the bulletin board is divided into an image information display area l0*a* and a literal information display area l0*b*. Usually, the volume of data of literal information is smaller than that of image information. According to the ninth example, when image information and literal information are displayed on one screen in mixture, only the literal information, which has a smaller volume, is erased from the display area l0*b*. Thereby, the consumption of electric power for execution of the erasure mode can be reduced.

Tenth Example of Erasure Mode

In the tenth example, after the whole first screen and the second screen are erased, either one of the display layers 11R, 11G and 11B is driven to set the first screen and the second screen wholly in the color of the driven display layer. Thereby, the user can be informed of the facts that erasure of the screens have been executed and that the battery has been used up.

Information Display Device with a Speaker

Figure 20:
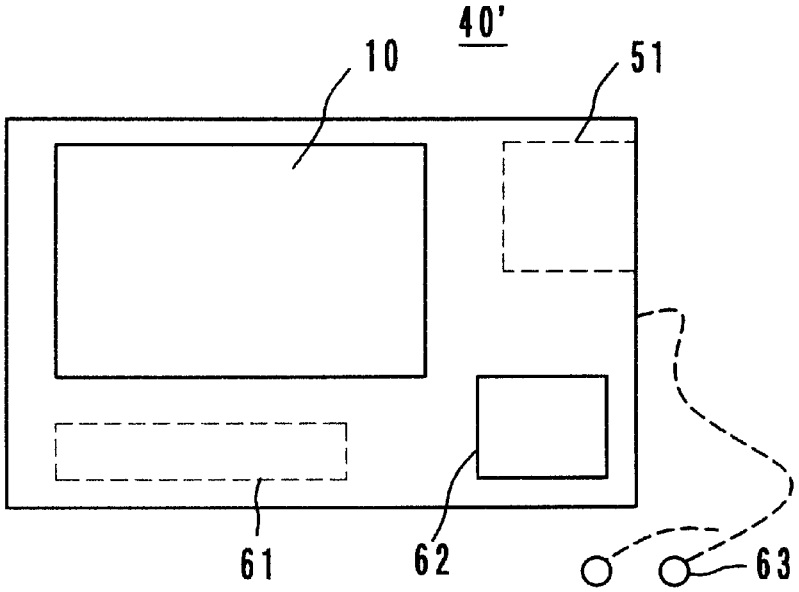
FIG. 20 is a front view of an electronic book with a speaker.

FIG. 20 shows an electronic book 40' with a speaker 61. The speaker 61 is of a film type and is provided under the liquid crystal display 10. An operation section 62 for adjustment of volume and writing of information, etc., is provided integrally with a power source section. The speaker 61 is to reproduce audio information stored in the storage medium 51 such as an MD, a CD or the like. When the battery has been used up, for example, the speaker 61 reproduces a voice, "please exchange batteries" to alarm the user, and thereafter, erasure of the display 10 is performed. Even if the user does not see the display 10 at this time, the user can be instructed to exchange batteries. Further, the speaker 61 may be replaced with a head phone 63, or both the speaker 61 and the head phone 63 may be provided.

Information Display System

Figure 21:
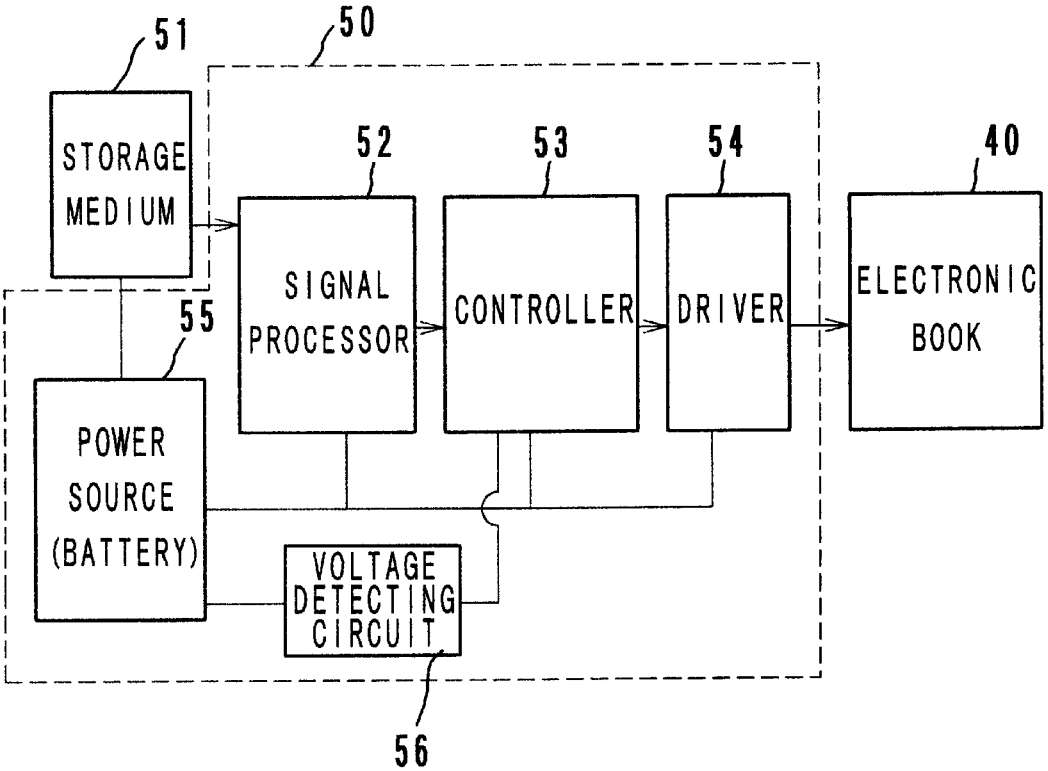
FIG. 21 is a block diagram which shows a first exemplary information display system incorporating the electronic book according to the present invention.

FIG. 21 shows a first exemplary information display system using the electronic book 40. This system is a combination of the electronic book 40 and a host device 50. The host device 50 comprises a signal processor 52, a controller 53, a driver 54 and a battery 55. The information storage medium 51 is a conventional storage medium such as a card type memory, a CD-ROM, a magnetic memory or the like. The user purchases or rents the storage medium 51 at a convenience store or the like and inserts the storage medium 51 into the host device 50. From the information storage medium 51, data are inputted to the signal processor 52. The remaining power of the battery 55 is figured out by inputting a voltage detected by a voltage detecting circuit 56 into the controller 53.

Figure 22:
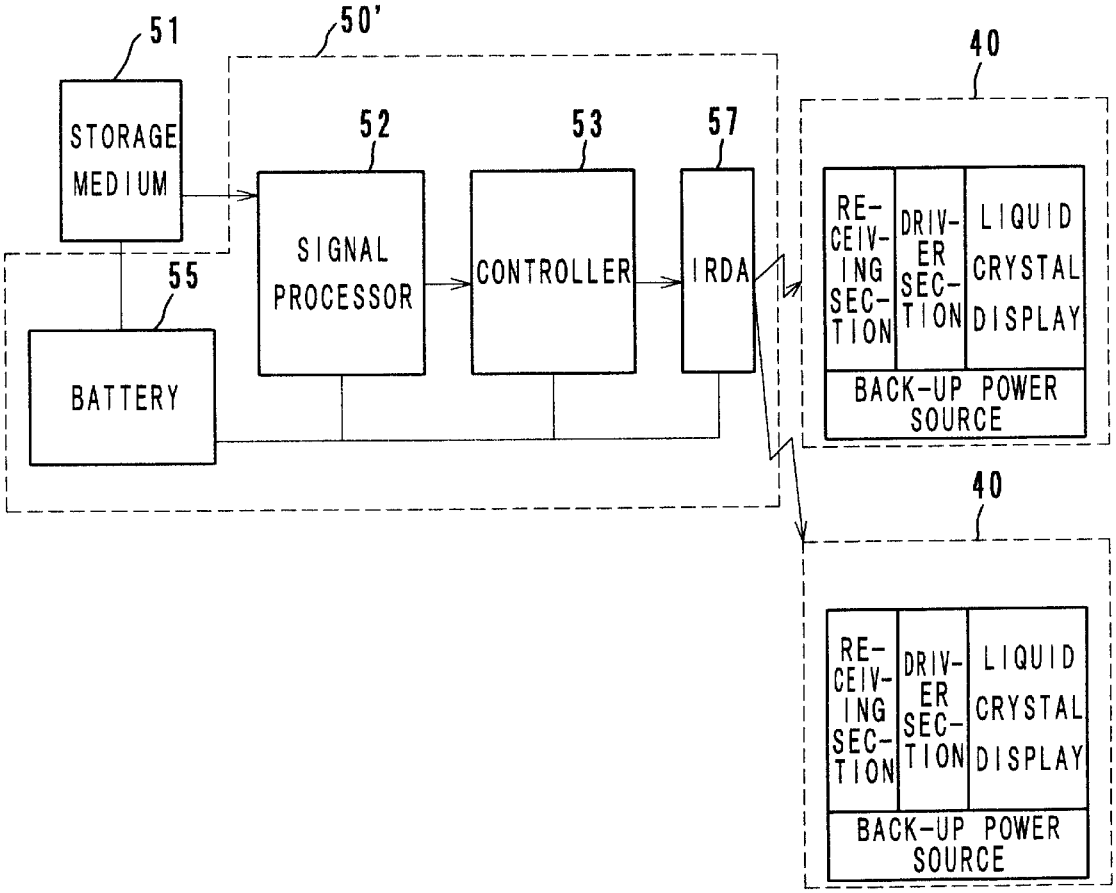
FIG. 22 is a block diagram which shows a second exemplary information display system incorporating the electronic book according to the present invention.

FIG. 22 shows a second exemplary information display system. In this system, a host device 50' is separated from the electronic book 40. In this system, therefore, from one host device 50', data can be transmitted to a plurality of electronic books 40.

The host device 50' has an IRDA 57 in its output section and transmits data to each of the electronic books 40 by remote control. With this system, for example, by installing the host device 50' in a room of a building, data can be transmitted from the host device 50' to a plurality of electronic books 40 installed in a plurality of places. In other words, a plurality of users can obtain information from the same source. The IRDA 57 may be replaced by any other communication means such as frequency modulating communication means.

Vending System

Figure 23:
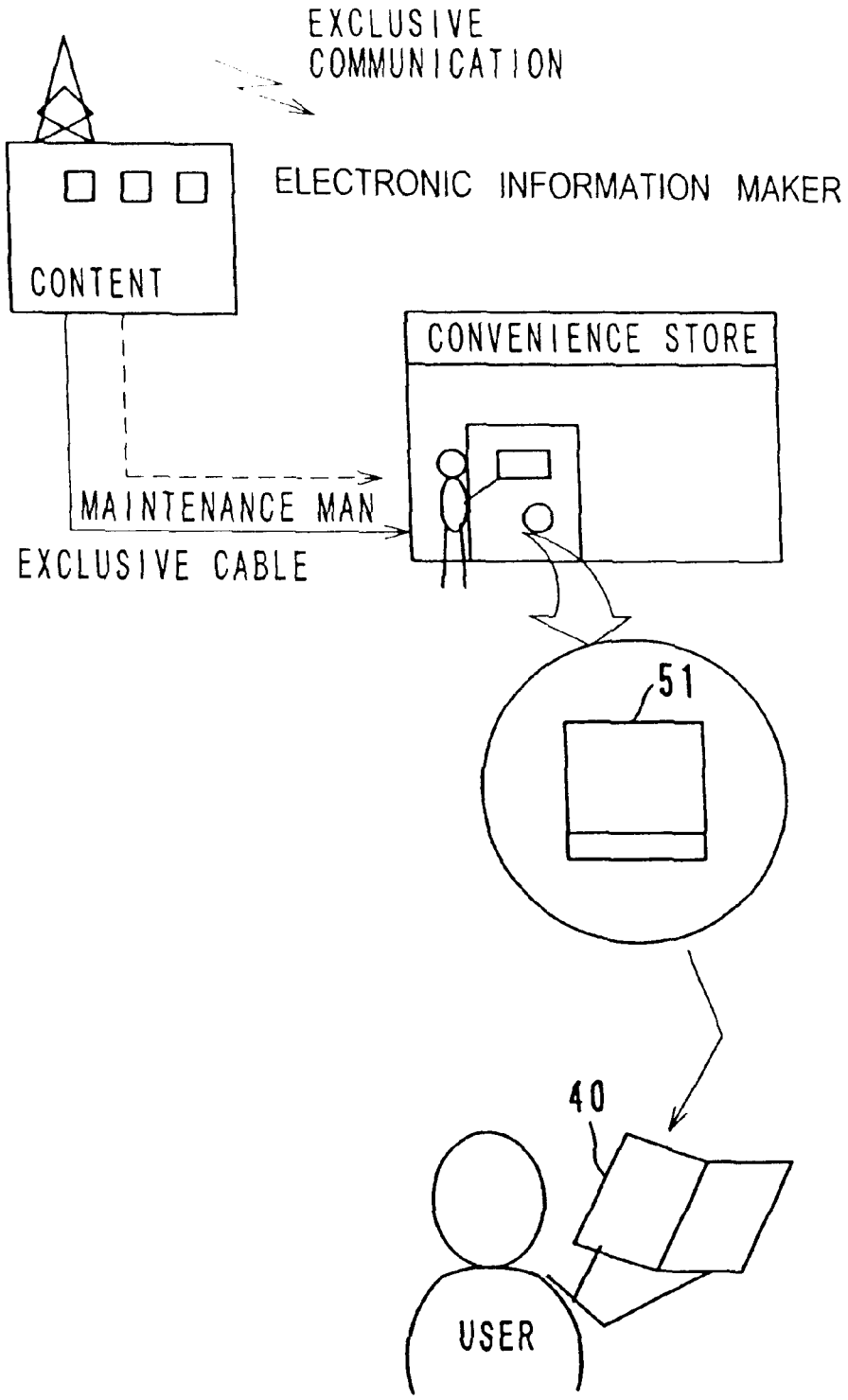
FIG. 23 is an illustration which shows a first exemplary storage medium vending system.

FIG. 23 shows a first exemplary vending system to distribute information storage media 51 to users of the electronic book 40.

The storage media 51 are produced by electronic information makers such as publishers and are carried to stores via exclusive cables or exclusive communication using radio waves or by maintenance men. A user purchases or rents such a storage medium at a store. A system wherein a user can store desired information in his/her electronic book 40 at a store is also possible.

Figure 24:
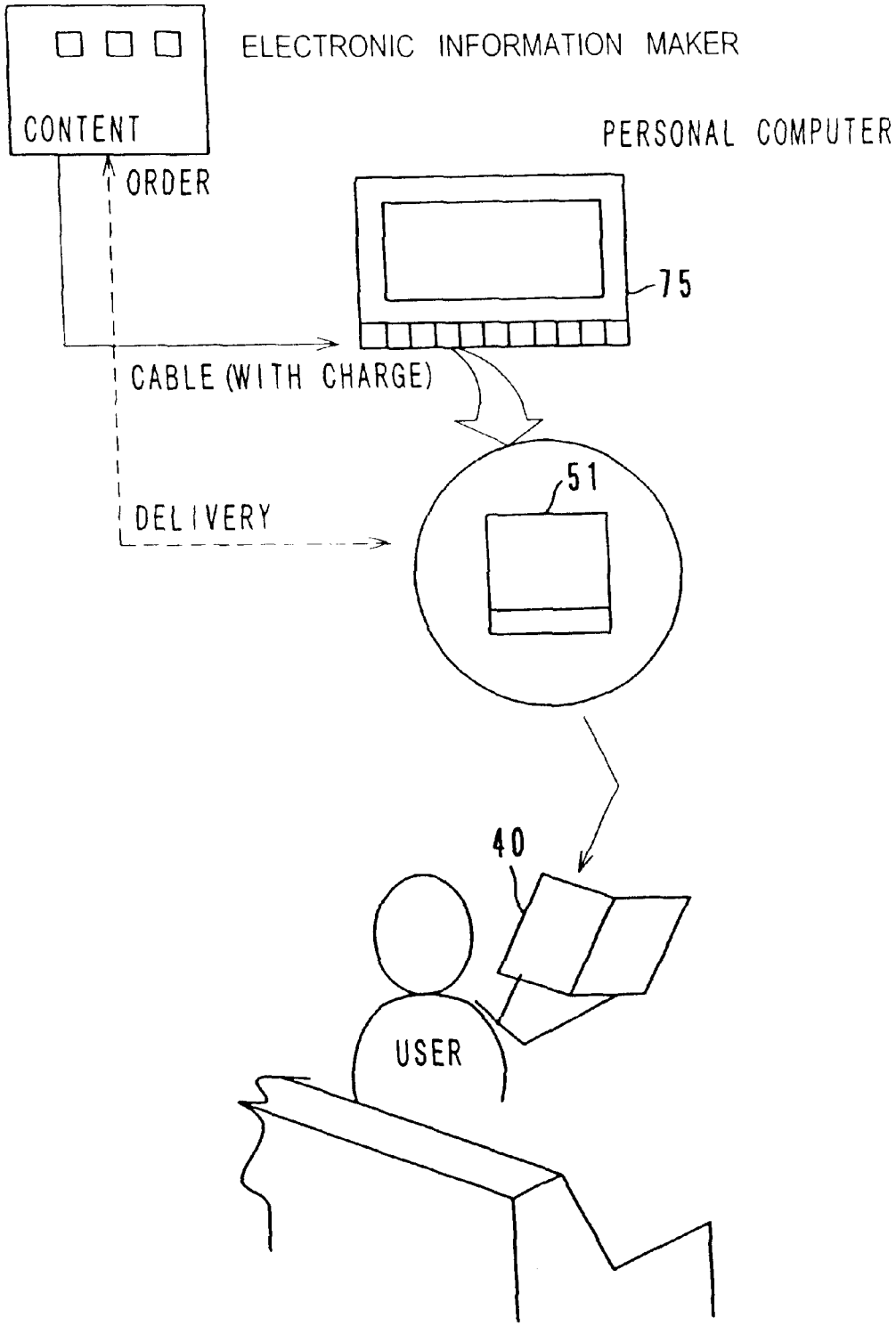
FIG. 24 is an illustration which shows a second exemplary storage medium vending system.

FIG. 24 shows a second exemplary vending system. In this vending system, a user orders desired information selected from a catalog or the like, and the electronic information maker transmits the information to the user's personal computer 75 via a cable (phone line). The user outputs the information on the display of the personal computer 75 transmitted thereto or stores the information in his/her storage medium 51 and inputs the information to his/her electronic book 40 via the storage medium 51. Also, the electronic information maker may deliver the storage medium 51 to the user.

Other Embodiments

Various materials such as ferrodielectric liquid crystal, electrochromic, etc. as well as chiral nematic liquid crystal can be used for the display with a memory effect. The power source may be a primary battery of any kind as well as a dry cell or may be a chargeable battery, capacitor or the like.

The present invention is applicable not only to electronic books but also other kinds of information display devices.

Although the present invention has been described in connection with the preferred embodiments above, it is to be noted that various changes and modifications are possible to those who are skilled in the art. Such changes and modifications are to be understood as being within the scope of the present invention.

What is claimed is:

1. An information display device comprising:

a display section which has a screen made of a material with a memory effect;

a power source section which supplies electric power;

a detecting section which detects a voltage supplied from the power source section;

an erasure mode selecting member with which a user selects an erasure mode to erase at least a portion of the screen; and a control section which executes the erasure mode on conditions that the erasure mode is selected and that the voltage detected by the detecting section is not more than a specified voltage.

2. An information display device according to claim 1, wherein the control section erases part of the screen in executing the erasure mode.

3. An information display device according to claim 2, wherein the control section erases the screen while skipping pixels at intervals in executing the erasure mode.

4. An information display device according to claim 1, wherein the display section displays an image indicating a detection result of the detecting section.

5. An information display device according to claim 1, wherein the display section has a plurality of screens.

6. An information display device according to claim 5, further comprising a screen selecting member with which a user selects a screen to be erased.

7. An information display device according to claim 5, wherein the control section figures out a number of screens which are capable of being erased in the erasure mode based on a detecting result of the detecting section and determines one or more screens to be erased in the erasure mode in accordance with the number of screens figured out.

8. An information display device according to claim 1, wherein the control section further erases the screen when the power source section is recharged to have a voltage more than the specified voltage.

9. An information display device according to claim 1, wherein the specified voltage is a voltage which is required to erase the screen.

10. A method for controlling a display section, which has a screen made of a material with a memory effect, of an information display device, said method comprising the steps of:

detecting a voltage of a power source section which supplies electric power to the information display device;

selecting an erasure mode to erase the screen; and executing the erasure mode on conditions that the erasure mode is selected and that the detected voltage is not more than a specified voltage.

11. An information display device comprising:

a display for displaying information using a material with a memory effect which is capable of keeping display information on the display in a state of the display not being supplied with electric power;

a driver for driving the display;

a power source for supplying electric power to the driver;

a detector for detecting the electric power supplied from the power source; and a controller for controlling the driver to erase the display when the electric power detected by the detector is not more than a specified level.

12. An information display device according to claim 11, wherein said driver sets the display to a focal-conic state to erase the display based on an instruction from the controller.

* * * * *